United States Patent [19]

Kanies

[11] Patent Number: 4,660,323

[45] Date of Patent: Apr. 28, 1987

[54] HOLLOW DOOR SEALING WEDGE

[76] Inventor: David E. Kanies, 532 Skiff Cir., Redwood City, Calif. 94065

[21] Appl. No.: 837,278

[22] Filed: Mar. 7, 1986

[51] Int. Cl.[4] ..... E06B 7/00

[52] U.S. Cl. ..... 49/70; 49/475; 15/257 R; 292/343

[58] Field of Search ..... 49/70, 406, 495, 498, 49/475; 292/343; 160/40; 15/257 R

[56] References Cited

U.S. PATENT DOCUMENTS

| | | | |
|---|---|---|---|
| 1,883,609 | 10/1932 | Dennis | 49/495 |
| 3,518,793 | 7/1970 | Hirtle | 49/498 X |
| 3,899,260 | 8/1975 | Kerschner | 49/498 X |
| 4,178,717 | 12/1979 | Sakauye | 49/70 |
| 4,449,267 | 5/1984 | Siemion | 49/70 X |

FOREIGN PATENT DOCUMENTS

| | | | |
|---|---|---|---|
| 581038 | 7/1933 | Fed. Rep. of Germany | 49/495 |
| 800491 | 7/1936 | France | 49/495 |

*Primary Examiner*—Philip C. Kannan
*Attorney, Agent, or Firm*—T. R. Zegree

[57] ABSTRACT

A durable, resilient, hollow sealing wedge extending all along the entire width of a door comprises a solid outer body portion including three outwardly extending projections and an empty interior. When squeezed into the space between the door edge and the floor, the wedge provides a seal which prevents a floor stripping solution from passing to the floor area on the opposite side of the door.

17 Claims, 4 Drawing Figures

HOLLOW DOOR SEALING WEDGE

BACKGROUND OF THE INVENTION

The present invention is related to an improved door sealing wedge. More particularly, the invention relates to a hollow, compressible wedge , the construction of which is adapted to prevent leakage of a stripping solution to the opposite side of the door when the wedge is inserted in operative position into the space between the bottom edge of the door and the adjacent floor surface.

In my copending patent application Ser. No. 684,377, now U.S. Pat. No. 4,611,429 I have described an elongated door sealing wedge having a solid body throughout its length.

Various types of short door stops designed to secure a door in any desired open position to prevent it from swinging have been described in prior patents, as exemplified by U.S. Pat. No. 1,845,829 to Carnal. Other types of devices adapted for sealing the gap between a door and the floor have been developed for attachment to the lower portion of the door. However, such devices interfere with the movement of the door from closed to open position. Devices unattached to a door and adapted for sealing the gap between the door and the floor have likewise been described in the patent literature. Thus, in U.S. Pat. No. 4,178,717 to Sakauye, a device for placing beneath the door to prevent entry of noise, air, dust and other pollutants is disclosed whereby the sealing surface of the device is in contact with the vertical face of the door. U.S. Pat. No. 4,449,267 to Siemon describes a device for placing under a door to block the flow of a floor stripping liquid, including a sponge strip and an adhesive strip secured to the floor. German Pat. No. 581,038 to Scheu teaches a packing strip for gaps and seams on vehicle doors and windows comprising a stationary piece fastened to the vehicle's door frame.

While my copending application and the latter three above-mentioned patents disclose specific sealing devices, the present invention provides a new approach to the structural form of a door sealing wedge which offers certain advantages over the prior art devices.

OBJECTS OF THE INVENTION

In view of the foregoing, it is the principal object of this invention to provide an improved hollow wedge specifically adapted for sealing the space between the closed door and the floor thereby preventing leakage of a floor stripping liquid across such space.

Another object of the invention is to provide an effective hollow sealing device which is flexible, non-absorbent and adhesive-free and which is adapted to contain a solution employed in a floor stripping operation within the area to be stripped when squeezed into the entire space between a closed door and the floor.

A further object of the invention is to provide one-piece resilient door sealing wedge which is not affixed to the bottom portion of a door but contacts it all along the width thereof when placed in operative position thereby forming a liquid-tight barrier for passage of a stripping liquid therethrough to the adjoining floor area.

A still further object of the present invention is to provide a hollow wedge characterized by greater flexibility for insertion under a door to achieve a tight seal than a solid wedge of similar type.

Still another object of the invention is the provision of a unitary sealing wedge of the character described herein which can be manufactured in volume quantities at a low cost from readily available materials.

BRIEF SUMMARY OF THE INVENTION

These and other objects of the present invention will become more fully apparent from the following description taken in conjunction with the accompanying drawing.

In accordance with the invention, there is provided a hollow, resilient door sealing wedge comprising an elongated body member having a solid body portion and an empty inner portion and including a front, rear and top projection extending from central portion thereof, said front projection being adapted for insertion into space between a door and the floor, said body member having an arcuate bottom surface, said wedge preventing passage of floor stripping liquid through said space when inserted therein in operative position.

BRIEF DESCRIPTION OF THE DRAWING

The invention will now be more fully described with reference to the accompanying drawing wherein like reference characters designate corresponding elements throughout the views thereof.

DETAILED DESCRIPTION OF THE INVENTION

Figure 1:
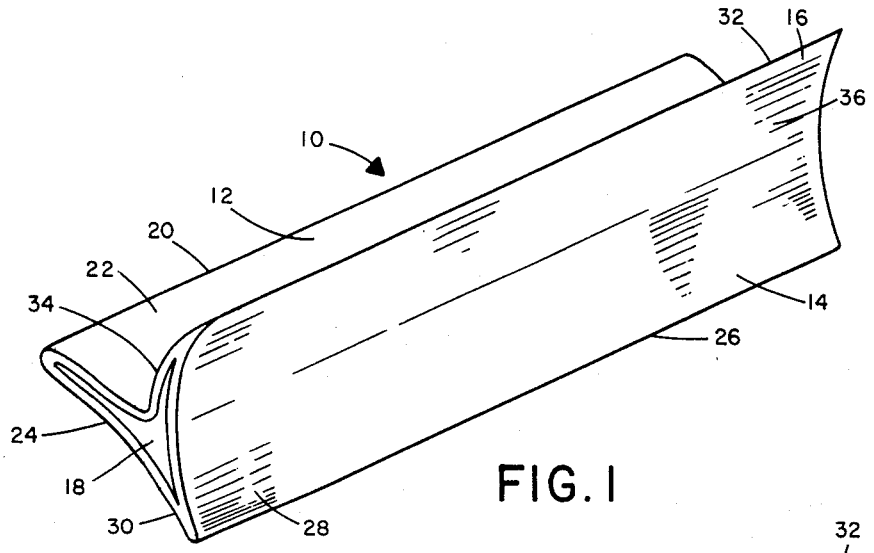
FIG. 1 is a perspective view of the sealing wedge of the invention.
Figure 2:
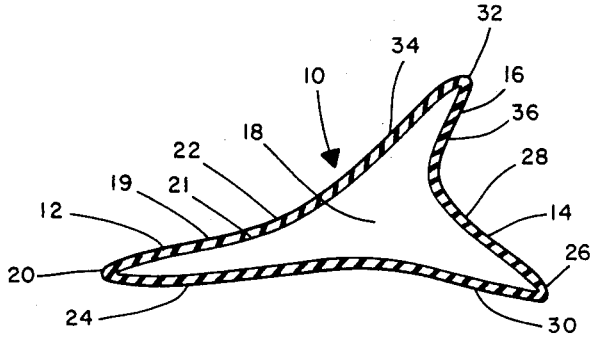
FIG. 2 is an enlarged crosssectional view of the sealing wedge.

Referring now to the drawing illustrating the invention in its preferred embodiment, a highly flexible, hollow, unitary door sealing wedge 10, as shown in FIGS. 1 to 4, comprises a horizontally elongated body member having a hollow interior and provided with three outwardly extending projections, i.e. a front projection 12, a rear projection 14 and a top projection 16, all three projections having inwardly curved surfaces not affixed to either a door or the floor and being integrally interconnected by their respective edge portions.

It is an important feature of this invention to provide a novel structure of the body member of wedge 10 comprising an empty portion 18 in the center thereof extending throughout the entire length of the wedge. As shown particularly in FIG. 2, each of the three projections of the body member comprises an outer surface 19 having a convex curvature and an inner surface 21, the latter having a perimeter substantially parallel to outer surface 19. Wedge 10 is formed in such a manner that the empty portion 18 represents a preponderant portion of the body member, compared to the solid body portion thereof which, accordingly, defines but a small proportion of the body member. The thickness of the solid body portion is substantially uniform and ranges from about 1/16 inch to about ½ inch, preferably from ⅛ inch to ¼ inch.

Front projection 12 extends generally laterally and includes a pointed leading tip or end 20 which is adapted for removable insertion and forward advancing of wedge 10 into the space between the bottom 42 of door 38 and the floor. Front projection 12 has an arcuate and concave upper surface 22 which slopes upward and rearward from leading end 20 toward upper end 32 of top projection 16 and bottom surface 24 likewise sloping upward and rearward from common end 20 toward the central portion of wedge 10.

Rear projection 14 likewise extending generally laterally is of substantially the same configuration as front projection 12, but somewhat shorter. It also comprises a pointed trailing end 26, an arcuate upper surface 28 inclined upward and frontward from end 26 toward rear surface 36 of top projection 16 and bottom surface 30 inclined upward and frontward from end 26 to merge with bottom surface 24 of front projection 12. Thus, the bottom surfaces of both the front and rear projections of wedge 10 form jointly a continuous concave surface which is adhesive-free, the mid-portion of which being detached from the floor surface before insertion of wedge 10 under the door into the space between the door and the floor. When inserted under the door in operative position, the two surfaces 24 and 30 tend to form almost a flat surface in contact with the floor, yet leaving a small clearance therebetween depending on the flexibility of the wedge and the extent of manual pressure exerted thereon during its insertion into the space under the door.

Figure 4:
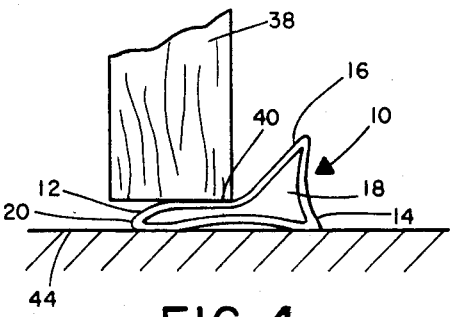
FIG. 4 is a view similar to that of FIG. 3 showing the wedge in operative position in abutting engagement with the edge of the door.

When disposed in operative position, bottom surface 30 of rear projection 14 forms a primary seal with the floor surface and bottom surface 24 of front projection 12 also contacting the floor forms a secondary, auxiliary seal between the door bottom 42 and floor 44, while a portion of the upper surface 22 of front projection 12 is in close abutting engagement with bottom edge 40 of door 38 and the leading end 20 of front projection 12 extends under the door bottom 42, as shown in FIG. 4. It will be noted that the height of the upper portion of front projection 12 is greater than the distance between the bottom door 38 and the floor 44 to insure a leakproof seal therebetween.

Figure 3:
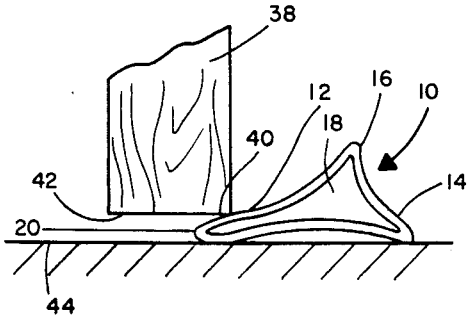
FIG. 3 is a side elevational view of the wedge before its placement in operative position between a door and the floor.

The structure of top projection 16 is generally similar to that of projections 12 and 14. It comprises upper end 32, concave front surface 34 inclined frontward and downward merging with upper surface 22 of front projection 12 and rear surface 36 likewise inclined frontward and downward merging with upper portion of surface 28 of rear projection 14. Top projection 16 is disposed generally upwardly and rearwardly from the center of wedge 10 and the end 32 thereof is positioned remotely from the vertical surface of door 38 just prior to the insertion of the wedge under the door, as shown in FIG. 3, as well as when squeezed into sealing engagement therewith, as shown in FIG. 4.

To position wedge 10 as an effective door seal, it is placed on the floor adjacent the entire width of the bottom of the door, then advanced by applying manual pressure on surfaces 28 or 36 until a satisfactory sealing engagement between bottom 42 of door 38 and upper surface 22 of front projection 12 is achieved. Thus the function of the rear surfaces 28 and 36 of wedge 10 is to provide an area suitable for pushing it until a tight sealing contact between the door and the floor is achieved and to protect the lower portion of the door from being splashed upon during mopping of the stripping solution on the floor or during subsequent machine scrubbing of the softened floor finish.

It will be understood that after front projection 12 has been properly inserted under the door in operative position, upper surface 22 of front projection 12 is flexed under pressure exerted by pointed edge 40 of the closed door 38 thereby providing a snug, liquid-tight sealing contact between door edge 40 and the floor surface throughout the width of the door in addition to the seal formed initially by rear projection 14 and the floor. It will be noted that the function of wedge 10 is versatile, as it may also be placed in operative position by inserting rear projection 14 or top projection 16 in the space between a door and the floor depending on the respective dimensions of the space and of the wedge projections. After the stripping operation has been completed, the wedge is easily removed from under the door and may be stored for reuse.

The wedge of the invention may be fabricated from a single material, such as synthetic or natural rubber or any suitable flexible plastic material, such as vinyl, by any of the well known molding procedures. The flexibility of the wedge is very important and contributes materially to complete adherence of portions of the wedge contacting the edge area of the door and the floor surface. Thus a satisfactory plastic or rubbery material should have a Shore durometer hardness within a range of about 50 Å to 100 Å, preferably from 70 Å to 90 Å. Using a wedge having a relatively low degree of hardness, as indicated herein, less pressure is required to achieve the desired leakproof sealing contact. If desired, the wedge may be dyed in bright orange or yellow color to warn persons passing by that a stripping operation is in progress.

The length of the wedge may vary in the range of from about 30 inches to 48 inches or even longer, as long as it is sufficient to seal the entire space between a door and the floor. Although the dimensions of each of the three projections may vary to some extent, a satisfactory length of the front projection from the center of the wedge to the tip of the projection may range from about 1 inch to 4 inches, the length of the rear projection from about $\frac{3}{4}$ inch to 3 inches and the length of the top projection from about $\frac{1}{2}$ inch to $2\frac{1}{2}$ inches.

It will be apparent from the foregoing description that I have devised an improved hollow door sealing wedge having a large empty inner portion and a solid outer portion, the body of the wedge having a substantially uniform configuration throughout its length. The wedge is particularly useful to institutions requiring relatively frequent floor stripping for sanitary reasons, such as hospitals, schools, office buildings and the like. It effectively prevents the passage of a floor stripping solution containing strong alkaline detergents or organic solvents through the gap under the door to the adjacent floor area and thus preventing unavoidable damage to good floor finish or carpeting on the opposite side of the door. The sealing wedge of my invention is characterized by a combination of novel structural features required for its basic function and by certain desirable important properties, including high resiliency and compressibility under pressure, resistance to penetration by alkaline solutions or organic solvents, nonabsorbency and durability. Due to simplicity of its construction from a single material suitable for being integrally molded into a light weight finished product, it may be manufactured in large volume less expensively than a solid wedge of the same size, inasmuch as it requires but a small fraction of the plastic or rubber material employed in the manufacture of a solid wedge, the solid portion of the entire body member of the hollow wedge defining only about one-third of the body of a solid door wedge.

It will be understood that various modifications in the form or in the constructional details of my invention as herein described in its preferred embodiment may be made without departing from the spirit thereof or the scope of the claims which follow.

I claim:

1. A hollow, resilient door sealing wedge comprising an elongated body member having a solid body portion and an empty inner portion and including a front, rear and top projection extending from central portion thereof, said front projection being adapted for insertion into space between a door and floor, said top projection being positioned remotely from vertical surface of said door when said wedge is inserted under said door, said body member having an arcuate bottom surface, said wedge preventing passage of floor stripping liquid through said space when inserted therein in operative position.

2. A sealing wedge of claim 1 wherein said empty inner portion extends throughout the entire length of said wedge.

3. A sealing wedge of claim 1 wherein said body member comprises an outer surface and an inner surface, said inner surface having a perimeter substantially parallel to perimeter of said outer surface.

4. A sealing wedge of claim 1 wherein the thickness of said solid body portion is substantially uniform.

5. A sealing wedge of claim 1 wherein the thickness of said solid body portion is from about 1/16 to about $\frac{1}{2}$ inch.

6. A sealing wedge of claim 1 wherein the thickness of said solid body portion is from about $\frac{1}{8}$ to about $\frac{1}{4}$ inch.

7. A sealing wedge of claim 1 wherein said front and rear projections extend laterally and said top projection extends generally upwardly and rearwardly from said central portion.

8. A sealing wedge of claim 1 wherein said bottom surface is adhesive-free and the mid-portion thereof is detached from the floor surface.

9. A sealing wedge of claim 1 wherein the rear surface of said top projection forms an acute angle with the horizontal.

10. A sealing wedge of claim 1 wherein rear surface of said top projection forms an angle of from about 50° to 80° with the horizontal.

11. A sealing wedge of claim 1 wherein said front projection is removably insertable into said space between the door and the floor.

12. A sealing wedge of claim 1 wherein bottom surfaces of said front and rear projections slope upwardly toward central portion of said wedge.

13. A sealing wedge of claim 1 wherein bottom surfaces of said front and rear projections form a continuous concave surface.

14. A sealing wedge of claim 1 wherein the surfaces of said front, rear and top projections merge with each other to form concave curvatures.

15. A hollow, flexible door sealing wedge for forming a liquid-tight barrier for passage of a floor-stripping solution between a door and the floor comprising a one-piece elongated body member having an outer solid portion and an inner empty portion therein, a front, a rear and a top projection merging in central portion thereof, said front projection having a leading end adapted for insertion between the door and the floor, said top projection being positioned remotely from vertical surface of said door when said wedge is inserted under said door, said solid portion defining a small fraction of said body member.

16. A sealing wedge of claim 15 wherein said solid portion defines about one-third of said body member.

17. A sealing wedge of claim 15 wherein said body member has a Shore durometer hardness in the range of from about 50 Å to 100 Å.

* * * * *